US005521459A

United States Patent [19]

Kim

[11] Patent Number: 5,521,459

[45] Date of Patent: May 28, 1996

[54] LIQUID COOLING TYPE PROJECTION CATHODE RAY TUBE

[75] Inventor: Sang-muk Kim, Suwon, Rep. of Korea

[73] Assignee: Samsung Electron Devices Co., Ltd., Kyungki-do, Rep. of Korea

[21] Appl. No.: 405,117

[22] Filed: Mar. 16, 1995

Related U.S. Application Data

[63] Continuation of Ser. No. 63,490, May 19, 1993.

[30] Foreign Application Priority Data

Dec. 15, 1992 [KR] Rep. of Korea ..... 92-25540

[51] Int. Cl.[6] ..... H01J 29/89

[52] U.S. Cl. ..... 313/36; 313/477 R; 313/482

[58] Field of Search ..... 313/33, 34, 35, 313/36, 44, 45, 46, 477 R, 482; 348/823, 825, 826, 832, 836

[56] References Cited

U.S. PATENT DOCUMENTS

| | | | |
|---|---|---|---|
| 2,167,451 | 7/1939 | Bowie | 313/477 R |
| 2,189,261 | 2/1940 | Bowie | 313/477 R |
| 4,532,513 | 7/1985 | Halvorson | 340/971 |
| 4,731,557 | 3/1988 | Asano et al. | 313/36 |
| 4,780,640 | 11/1988 | Hasegawa | 313/36 |
| 4,934,976 | 6/1990 | Lane et al. | 445/52 |

*Primary Examiner*—Sandra L. O'Shea
*Assistant Examiner*—Vip Patel
*Attorney, Agent, or Firm*—Lowe, Price, LeBlanc & Becker

[57] ABSTRACT

A projection cathode ray tube has a liquid coolant coupling apparatus whose structure is improved. The projection cathode ray tube includes a funnel having an electron gun in its neck end and a face plate provided with a screen at the other end, a rectangular radiating plate having a frontal glass corresponding to the face plate having the screen inside thereon, and being firmly attached to the face plate, a liquid coolant layer having a predetermined thickness between the face plate and the frontal glass of the radiating plate, a clamping portion coupled by means of a bolt at each corner of the rectangular radiating plate, and a setting clasp having a contacting surface of a predetermined size in contact with the side of the funnel and a spring both provided over each bolt, whereby the setting clasp settles the funnel while pressing.

1 Claim, 3 Drawing Sheets

LIQUID COOLING TYPE PROJECTION CATHODE RAY TUBE

This is a continuation of copending U.S. patent application Ser. No. 08/063,490, filed May 19, 1993.

FIELD OF THE INVENTION

The present invention relates to a projection cathode ray tube, and more particularly to a projection cathode ray tube wherein the structure of a liquid coolant coupling apparatus is improved.

BACKGROUND OF THE RELATED ART

A projection television is a type of television system for projecting and enlarging images by allowing three special cathode ray tubes to emit the three primary colors of red, green and blue using a magnifying lens and a reflecting mirror. Although projection televisions utilize cathode ray tubes as do general television receivers, they utilize different methods for forming an image to display on a screen. In more detail, the general television cathode ray tube is limited in its screen size. Thus, not only does the fabrication of large-sized cathode ray tubes present several technical problems, but also the inherent bulk and weight resulting from the enlargement acts as a limiting factor in their production. Therefore, the projection television comes to the forefront as a means capable of obtaining a large-sized screen while solving the above-described problems. In projection televisions, the cathode ray tube itself functions as the electron gun of the general television cathode ray tube, and light radiating from the cathode ray tube passes through a projection lens via a color-selective mirror. Thereafter, the light reflected by means of a reflecting mirror finally forms an image on a large-sized screen separated from the cathode ray tube. This is the typical principle of the projection TV.

However, in such projection televisions, considerable heat is generated in the panel of the cathode ray tube, which raises the problem of dealing with the generated heat. Due to this fact, a liquid coolant coupling apparatus containing a liquid coolant, which is a kind of a radiator, is installed in the front of the panel. One example of the liquid coolant coupling apparatus is illustrated in FIG. 1 whose explicit construction will be described below.

FIG. 1 is a schematic side view of a conventional liquid coolant coupling apparatus in a projection cathode ray tube, and FIG. 2 is a plan view thereof. As illustrated in FIGS. 1 and 2, an anode cap 2 supplied with a high voltage is formed on the side of a cathode ray tube 1. A gripping plate 5 which is for pressing so as to fix cathode ray tube 1 to a radiating plate 6 by screwing four bolts 3 is fixed to the front of cathode ray tube 1. Each bolt 3 has a spring 4 for fine adjustment of the screw pressure.

As shown in FIG. 2, gripping plate 5 constituted as one body has a hole of a predetermined size formed in its center to allow the neck end of cathode ray tube 1 to be inserted therein. Also, four through holes for respective clamping bolts 3 are formed near the perimeter of gripping plate 5.

However, the conventional liquid coolant coupling apparatus constructed as above is disadvantageous in that the unavoidable approach of gripping plate 5 upon anode cap 2 and thus upon the anode leads to a risk of arcing as a high voltage is applied to the anode. Furthermore, the centering of cathode ray tube 1 and radiating plate 6 is difficult during their coupling, and the coupling apparatus is unnecessarily bulky and heavy.

SUMMARY OF THE INVENTION

The present invention is contrived intended to solve the above-described problems. Therefore, it is a principal object of the present invention to provide a projection cathode ray tube comprising a liquid coolant coupling apparatus, wherein the risk of arcing discharge is circumvented, and unnecessary bulk and weight are eliminated.

To achieve the above object of the present invention, there is provided a projection cathode ray tube, comprising:

- a funnel-shaped body having an electron gun in a neck end and a face plate provided with a screen at a projection end;
- a rectangular radiating plate having a frontal glass element corresponding to said face plate having said screen located inside thereof, firmly attached to said face plate;
- a liquid coolant layer, having a predetermined thickness and located between said face plate and said frontal glass of said radiating plate; and
- a plurality of clamping means each coupled by a bolt and a spring provided thereon at a respective corner of said rectangular radiating plate for clamping the radiating plate to the projection end of the funnel-shaped body and a setting clasp supported to each bolt, each setting clasp having a contacting surface of a predetermined size and biased by a corresponding spring to press the side of said funnel,
- wherein each setting clasp is provided with both a pad and a contact-maintaining rubber, with the contact-maintaining rubber being disposed between the side of the funnel and the contacting surface of the setting clasp.

First, the liquid coolant coupling apparatus employs a coupling-by-settling method, by means of a separated bolt-clamping portion which is different from the conventional single body-type gripping plate, so that there is no risk of arcing when supplying a high voltage.

Second, the coupling member for fixing the cathode ray tube, i.e., the setting clasp, is formed to allow the pressure obtained by screwing the bolt to approach the center of the cathode ray tube, thereby easing the centering maintenance.

Third, unnecessary size and weight are eliminated to thereby considerably enhance efficiency in manufacturing the product.

DETAILED DESCRIPTION OF THE PREFERRED EMBODIMENTS

Figure 1:
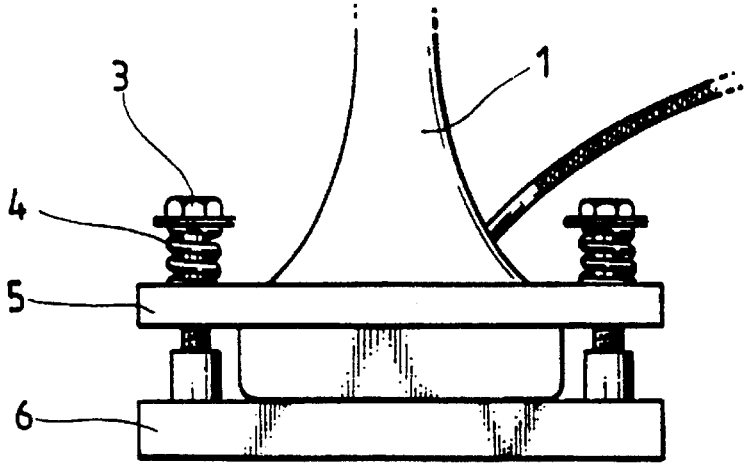
FIG. 1 (PRIOR ART)
FIG. 1 is a schematic side view of a conventional projection cathode ray tube.
Figure 2:
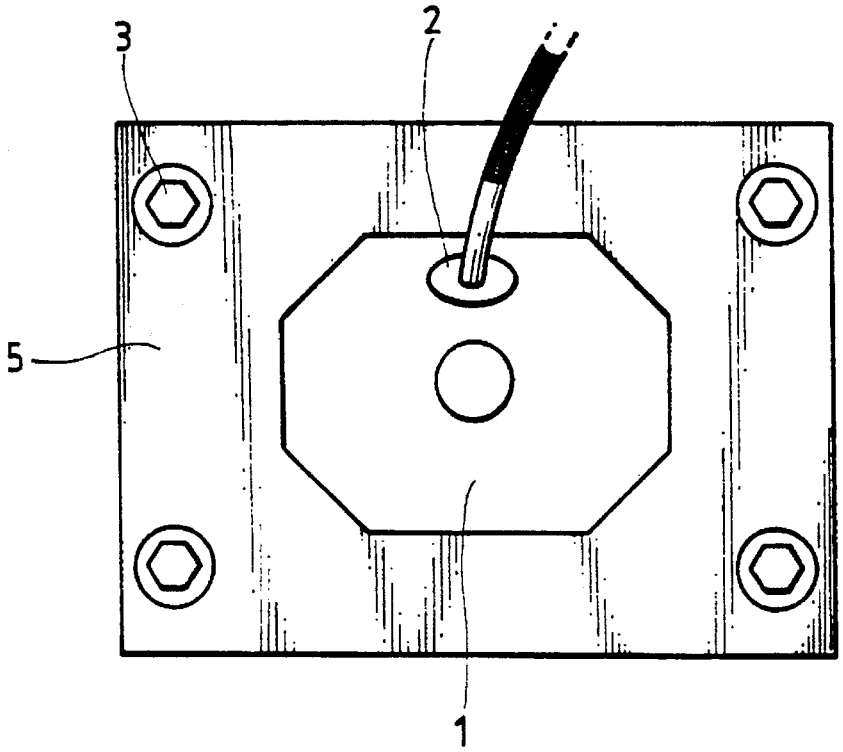
FIG. 2 (PRIOR ART)
FIG. 2 is a plan view of the projection cathode ray tube shown in FIG. 1.
Figure 3:
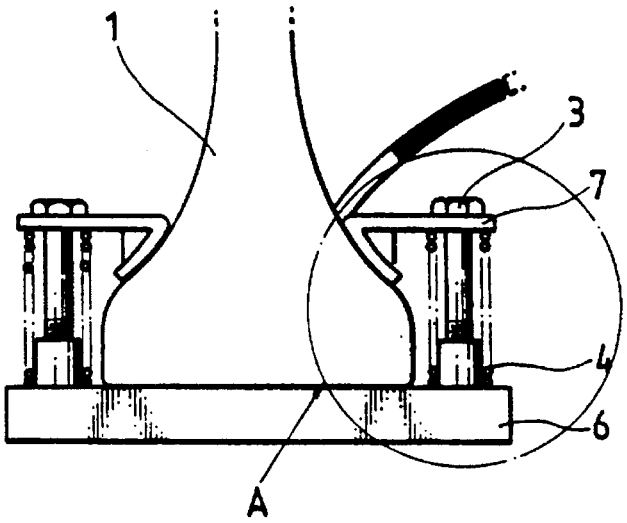
FIG. 3 is a schematic side view of a projection cathode ray tube according to the present invention, viewed from its shorter side.
Figure 4:
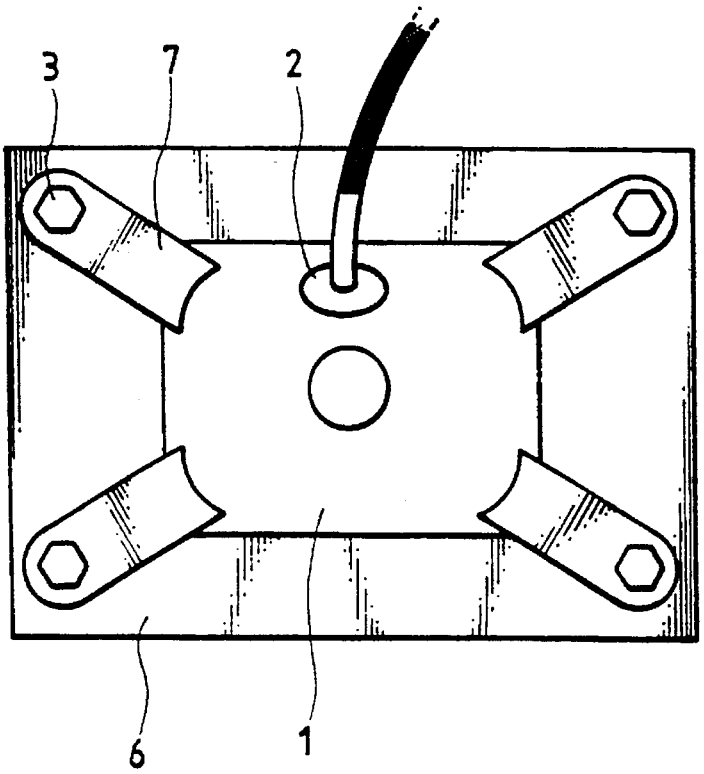
FIG. 4 is a plan view of the projection cathode ray tube shown in FIG. 3.

Referring to FIG. 3, a cathode ray tube 1 is seated at a projection end on a radiating plate 6, with its front panel facing toward the radiating plate. As shown in FIG. 4, a bolt-clamping portion is provided at each corner of radiating plate 6, so that cathode ray tube 1 is settled onto radiating plate 6 to thus couple the cathode ray tube to the radiating plate by means of setting clasps 7 which are clamped to and tightened by respective bolts 3. Also, a spring 4 is installed below each setting clasp 7 for fine adjustment of the pressure applied by the setting clasp 7 to the body of cathode ray tube 1.

Figure 5:
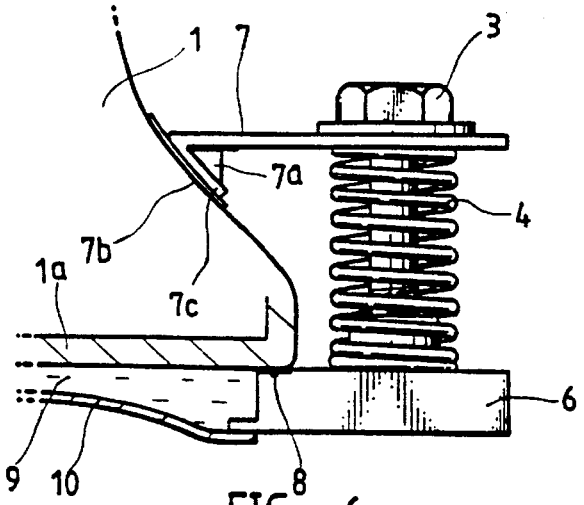
FIG. 5 is a schematic view showing a first embodiment of the liquid coolant coupling apparatus for the projection cathode ray tube according to the present invention, which corresponds to the portion A in FIG. 3 when viewed from its longer side.

FIG. 5 shows an enlarged detail view of a modified form of the portion A in FIG. 3 focusing the bolt-clamping portion. Setting clasp 7 which is a metallic member having a predetermined thickness and width, and it has a supporting portion ranging from cathode ray tube 1 to bolt 3 and a pressing portion 7*c* for firmly contacting the funnel of cathode ray tube 1. Especially, the pressing portion 7*c* should be closely attached to the curved surface of cathode ray tube 1, so the contacting surface is correspondingly shaped. A pad 7*a* for pressing cathode ray tube 1 by shifting the screwing force to pressing force is installed in the central body from the supporting portion to the pressing portion. In addition, a contact-maintaining rubber 7*b* is provided on the surface of the pressing portion contacting the cathode ray tube, for preventing not only damage to the contacting portion, but also to reduce vibration and slippage. Meanwhile, liquid coolant 9 fills up the space between a face plate 1*a* and frontal glass 10 of the cathode ray tube. Also, a sealing rubber 8 is installed at the contacting portion of face plate 1*a* and radiator 6, thereby preventing the leakage of coolant.

Figure 6:
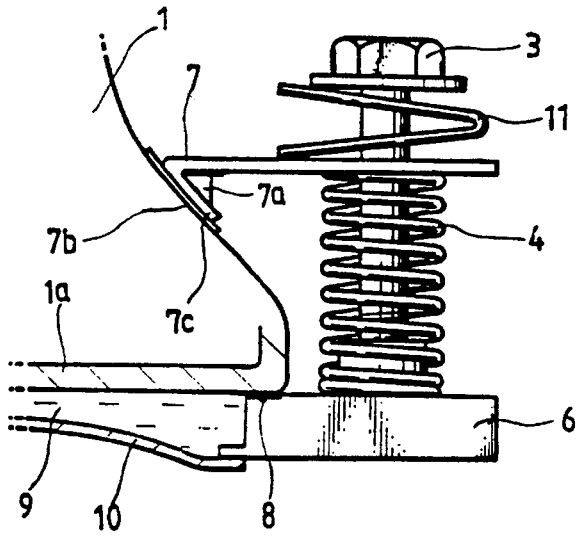
FIG. 6 is a schematic view showing a second embodiment of the liquid coolant coupling apparatus for the projection cathode ray tube according to the present invention, which corresponds to the portion A in FIG. 3 when viewed from its longer side.

FIG. 6 illustrates a second embodiment of the present invention. Here, a reinforcing member 11 is installed atop setting clasp 7 of the bolt-clamping portion. Reinforcing member 11 formed of sheet iron is bent in a V-shape and has a predetermined elasticity. The function of reinforcing member 11 prevents the upward distribution of force caused by the downward tightening of bolt 3 along the sloped plane of the contacting surface of cathode ray tube 1 and setting clasp 7 ultimately redirects the force of the contact portion around pad 7*a* toward the center of cathode ray tube 1, thereby facilitating centering.

Figure 7:
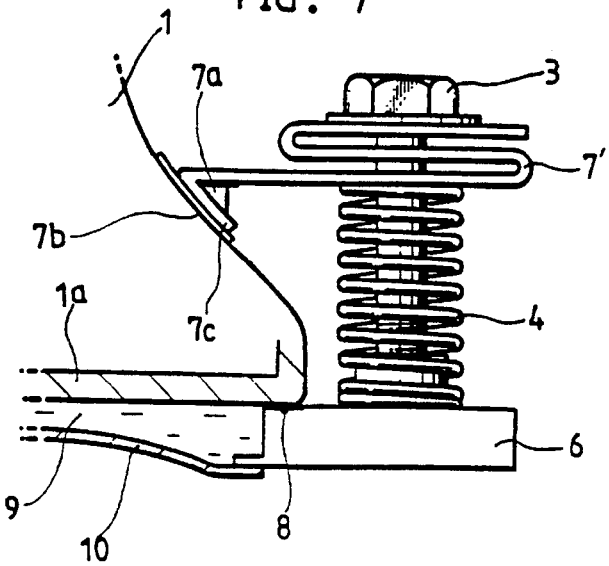
FIG. 7 is a schematic view showing a third embodiment of the liquid coolant coupling apparatus for the projection cathode ray tube according to the present invention, which corresponds to the portion A in FIG. 3 when viewed from its longer side.

FIG. 7 illustrates a third embodiment of the present invention. Here, the supporting portion of setting clasp 7' is partially curved in an S-shape. In this embodiment, setting clasp 7' has its own elasticity, while reinforcing member 11 has the same elasticity as in the second embodiment.

As described above, the projection cathode ray tube according to the present invention uses a fixed connection method for the liquid coolant coupling apparatus by means of a separated bolt-clamping portion, different from the conventional single body-type gripping plate. Therefore, there is no risk of arcing when high voltage is supplied to the anode. Moreover, the coupling member for settling the cathode ray tube, i.e., a setting clasp, is constructed so as to apply a pressing force caused by the tightening of the bolt toward the center of the cathode ray tube, thereby facilitating centering. Furthermore, the unnecessary bulk and weight are eliminated to thereby significantly enhance efficiency in manufacturing the product.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A projection cathode ray tube, comprising:

a funnel-shaped body having an electron gun in a neck end and a face plate provided with a screen at a projection end;

a rectangular radiating plate having a frontal glass element corresponding to said face plate having said screen located inside thereof, firmly attached to said face plate;

a liquid coolant layer, having a predetermined thickness and located between said face plate and said frontal glass of said radiating plate; and a plurality of clamping means each coupled by a bolt and a spring provided thereon at a respective corner of said rectangular radiating plate for clamping the radiating plate to the projection end of the funnel-shaped body and a setting clasp supported to each bolt, each setting clasp having a contacting surface of a predetermined size and biased by a corresponding spring to press the side of said funnel, wherein each setting clasp is provided with both a pad and a contact-maintaining rubber, with the contact-maintaining rubber being disposed between the side of the funnel and the contacting surface of the setting clasp.

* * * * *